US010858856B1

(12) United States Patent
Dusek

(10) Patent No.: US 10,858,856 B1
(45) Date of Patent: Dec. 8, 2020

(54) MODULAR TENT CONSTRUCTION AND COMPONENTS THEREOF

(71) Applicant: Jacob Dusek, Belgrade, MT (US)

(72) Inventor: Jacob Dusek, Belgrade, MT (US)

( * ) Notice: Subject to any disclaimer, the term of this patent is extended or adjusted under 35 U.S.C. 154(b) by 0 days.

(21) Appl. No.: 16/543,406

(22) Filed: Aug. 16, 2019

Related U.S. Application Data

(60) Provisional application No. 62/719,019, filed on Aug. 16, 2018.

(51) Int. Cl.

| | |
|---|---|
| ***E04H 15/18*** | (2006.01) |
| ***E04H 15/02*** | (2006.01) |
| ***E04H 15/56*** | (2006.01) |
| ***E04H 15/54*** | (2006.01) |
| ***E04H 15/36*** | (2006.01) |

(52) U.S. Cl.
CPC ..... *E04H 15/18* (2013.01); *E04H 15/02* (2013.01); *E04H 15/36* (2013.01); *E04H 15/54* (2013.01); *E04H 15/56* (2013.01)

(58) Field of Classification Search
CPC ..... E04H 15/18; E04H 15/36
See application file for complete search history.

(56) References Cited

U.S. PATENT DOCUMENTS

| | | | | |
|---|---|---|---|---|
| 3,374,797 | A * | 3/1968 | Neumark | E04H 15/64 135/97 |
| 3,533,202 | A * | 10/1970 | Gellert | E04B 1/344 52/80.1 |
| 3,773,061 | A * | 11/1973 | Berger | E04H 15/42 135/121 |
| 4,063,566 | A * | 12/1977 | Millerioux | E04H 15/18 135/97 |
| 5,159,948 | A * | 11/1992 | Moreau | E04H 15/18 135/125 |
| 6,357,462 | B1 * | 3/2002 | Laosunthara | A47D 13/063 135/115 |
| 8,001,987 | B2 * | 8/2011 | Williams | E04H 15/06 135/125 |
| 2006/0283103 | A1 * | 12/2006 | Chen | E04H 15/18 52/63 |

FOREIGN PATENT DOCUMENTS

| | | | | |
|---|---|---|---|---|
| DE | 29517290 U1 * | 12/1995 | | E04H 15/36 |
| FR | 2207225 A1 * | 6/1974 | | E04H 15/18 |
| FR | 2223058 A1 * | 10/1974 | | E04H 15/18 |
| WO | WO-2019031784 A1 * | 2/2019 | | F16B 2/18 |

* cited by examiner

*Primary Examiner* — Noah Chandler Hawk

(57) ABSTRACT

A modular tent construction with one or more tent pods including a pod roof, a frame system, and brackets and/or tensioners.

20 Claims, 11 Drawing Sheets

MODULAR TENT CONSTRUCTION AND COMPONENTS THEREOF

FIELD OF THE INVENTION

The present invention relates to modular structures and in particular, modular structures designed and constructed to withstand inclement and extreme weather conditions.

SUMMARY OF THE INVENTION

Aspects of the modular tent construction comprise an assembled structure, a kit for assembly, or components thereof, according to the description and drawings of the subject application.

Aspects of the invention include both an individual tent pod construction and a modular tent construction comprised of one or more tent pods that are further comprised of a fabric skin, a frame system, and brackets and/or tensioners. Preferred variations of the fabric skin. frame system, and brackets and/or tensioners are disclosed in the description and drawings. Aspects also include optional features such as awnings and linking structures or fabric that augment the pods or that facilitate connection of two or more pods.

A tent pod may be constructed from a pod roof, a frame system, and specialty and standard hardware. Aspects of the invention include pod roof comprised of a plurality of curved substantially triangular shaped roof sections connected together to form a curved pyramidal pod roof with a roof base and a roof apex. The frame system may comprise of a plurality of arches and a plurality of poles, with at least two of the arches having an arch end positioned adjacent another arch end, with an arch middle section coupled to the roof base, and with the poles coupled at first ends to the roof apex. Further aspects include that the curved substantially triangular shaped roof sections may each comprise n, n+1, n+2, curved substantially trapezoidal sub-portions with top and bottom base segments, each of the top base segments of all but one of the sub-portions coupled to the bottom base segment of another sub-portion, respectively. Aspects also include that the curved substantially triangular shaped roof sections may each comprise n, n+1, n+2, curved substantially trapezoidal sub-portions with top and bottom base segments, with each of the bottom base segments of all but one of the sub-portions coupled to the top base segment of another sub-portion, respectively.

Additional aspects include specialty hardware for construction of a tent pod or a modular tent pod. For example, a plurality of specialty base plates may positioned adjacent another arch end on one of the base plates, and the poles each have second ends, each of which are coupled to one of the base plates. Moreover, specialty hardware may be used to secure poles that hold up the pod roof.

Numerous other advantages and features of the present invention will become readily apparent from the following detailed description of the invention and the embodiments thereof, from the claims and from the accompanying drawings.

Figure 1A:
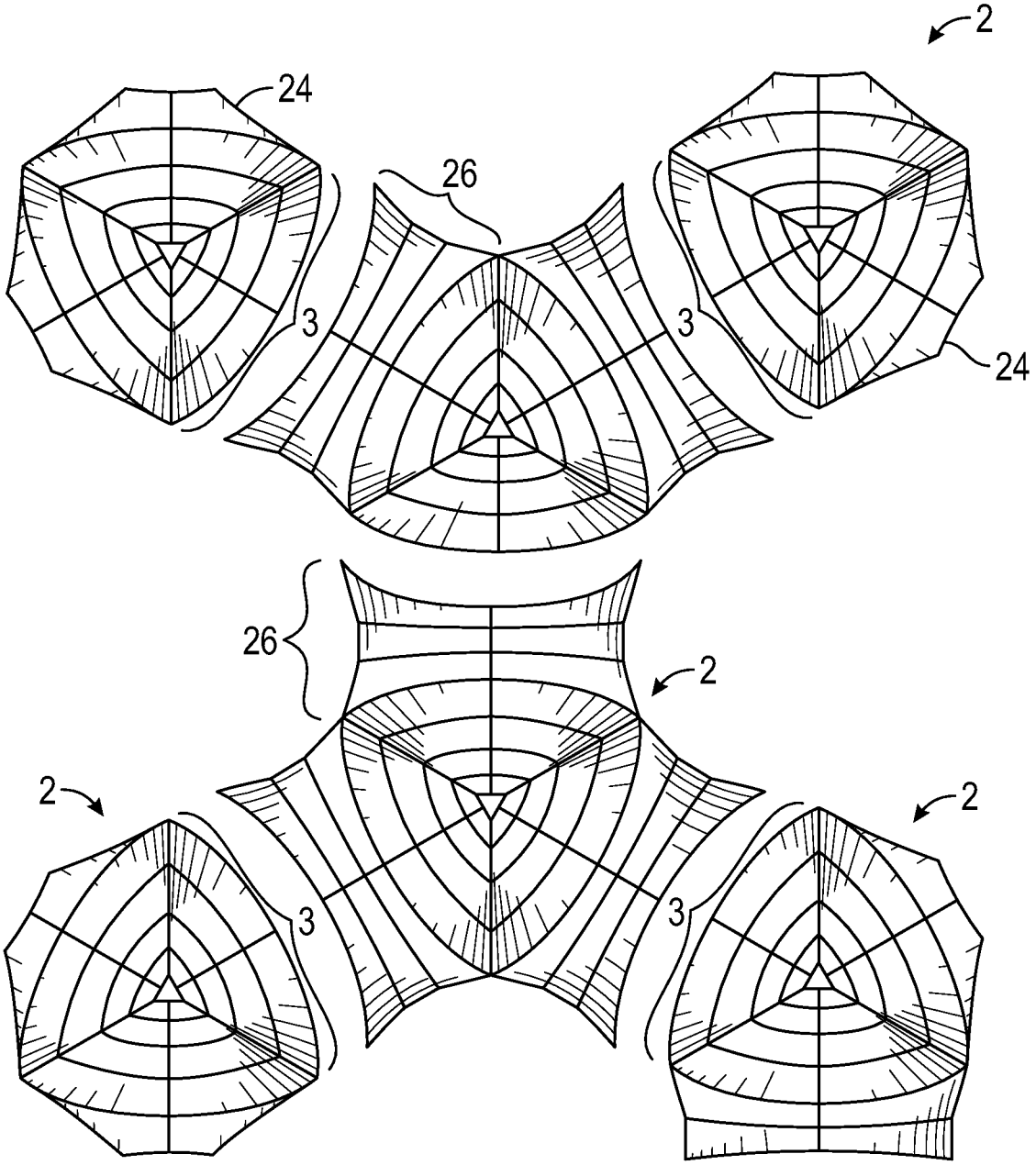
FIG. 1A illustrates a top view of a six tent pod 2 modular tent construction and the fabric skin.

The objects, features and advantages of the present invention will be more readily appreciated upon reference to the following disclosure when considered in conjunction with the accompanying drawings, wherein reference numerals are used to identify the components in the various views.

DESCRIPTION OF PREFERRED EMBODIMENTS

The figures illustrate an embodiment of a tent pod and a modular tent constructed according to the description and claims that follow. In general, the modular tent construction is adaptable and constructed to be temporary or permanent structure and may be a stand-alone structure or connected to an existing structure of the same of different construction. The modular construction of the modular tent construction facilitates scaling of structures by scaling one or more of the components while remaining within the teachings of this disclosure. The modular tent construction and components described herein can be adapted to any of a variety of curves, shapes, or designs with modest modifications.

Figure 1B:
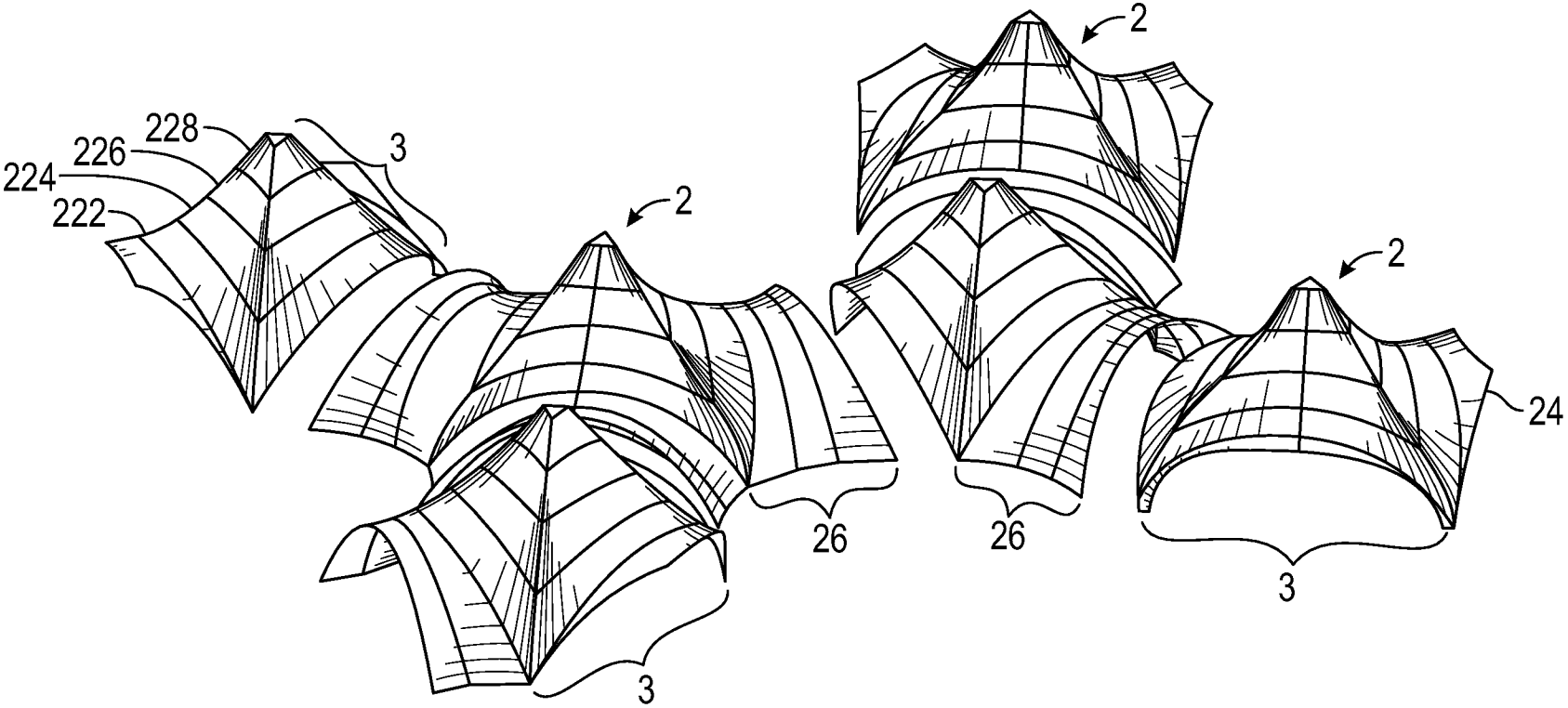
FIG. 1B illustrates an elevated perspective view of the six pod 2 modular tent construction.

In general, the modular tent construction is comprised of at least one tent pod 2 wherein the pod 2 is further comprised of fabric skin, a frame system, and a variety of connecting hardware including brackets and/or tensioners. FIGS. 1A and 1B illustrate a top view and side-elevated perspective view, respectively, of a modular tent construction comprised of six pods 2. Each constructed pod 2 may include components implementing certain aspects or features of the modular tent construction, which components facilitate building modular tent constructions comprised of one or many pods 2. Thus, as illustrated, in FIGS. 1A and 1B, a modular tent construction may comprise a plurality of pods 2, wherein at least one of the interior pods 2 is connectable or connected to at least one other pod 2, and possibly at least two other pods 2; and each pod 2 of the modular tent construction includes certain components but may omit other optional components. In preferred embodiments, the pod roof is constructed and coupled or secured to a frame comprised of arches and poles and specialty hardware and common fasteners.

Most generally, a tent pod 2 may include a pod roof comprised of an assembly of pod roof sections with substantially equivalent dimensions that are coupled together to form a pod roof. See FIG. 1A-1B. As best illustrated in FIG. 1A, each pod roof portion comprises a curved substantially triangular shape and may be coupled, such as by stitching, along its side edges or leg segments to another of the pod roof portion leg segments to create a three-sided pyramidal shaped pod roof having a pod roof vertex as illustrated in FIGS. 1A-1B. In preferred embodiments, each pod roof portion further comprises a composite of curved substantially trapezoidal fabric portions that are coupled together to form a curved substantially triangular shaped potion 3. See FIGS. 1A-1B. Being trapezoidal in form, each fabric portion has base segments on the top and bottom edges of the portions, and leg segments on the side edges of the portions and the leg segments of each fabric portion angle inward or towards each other so that the top base segment is shorter than the bottom base segment. To assemble a preferred pod roof, the pod roof sections are first created by constructing the composites of curved substantially trapezoidal fabric portions, and then each of the composites of curved substantially trapezoidal fabric portions is coupled along and to the side or leg segments of another composite of portions to form a pod roof and pod roof apex. Moreover, each composite of fabric portion may be comprised of a plurality (e.g. 222, 224, 226, 228) of curved substantially trapezoidal sub-portions 222-228, wherein the sub-portions 222-228 get successively smaller whilst retaining substantially the same leg segment length. To assemble each composite of fabric portions, top and bottom base segments and at least one of the top or bottom base segments of each sub-portion 222-228 is coupled to the bottom or base segments of another sub-portions 222-228, respectively. More specifically and for example, the bottom base segments of the third 226, and second 224, sub-portions are coupled along and to the top base segments of the second 224, and first 222, sub-portions, respectively, and the bottom base segment of the first 222 sub-portion is coupled to one of the arches.

The curved substantially trapezoidal portions may be separately cut from one or more sheets of fabric sheeting or alternately constructed, such as by weaving, sewing, or extruding, and subsequently connected together as described herein. A pod roof may then be constructed from coupling together, such as by stitching, several sections that are also each comprised of sub-portions 222-228 and that have decreasing dimensions. Generally, the curved substantially triangular shaped sections may each be constructed from sets of curved substantially trapezoidal sub-portions 222-228 of descending dimensions, or as is preferable, pod roof sections may comprise a plurality (e.g. four sets as illustrated) of curved substantially trapezoidal sub-portions 222-228, wherein each of the plurality is one of at least two descending and consecutively sized sub-portions 222, 224, 226, or 228. Each of the sub-portions 222-228 may have substantially the same length of trapezoid legs or side edges but the length of each ascending and consecutively sized sub-portion 222-228 is between about 1.5 to 2 times the base length of the previous sized sub-portion 222-228. A preferred and efficient fabric cut pattern comprises cutting each of the sub-portions 222-228 from a single rectangular piece of construction fabric or sheeting wherein each of the top and bottom edges of the sub-portions 222-228 are aligned substantially along the top and bottom edges of the rectangular piece of construction fabric or sheeting, respectively, and at least one of the end or side edges of each of the sub-portions 222-228 is aligned along the end or side edges of another of the sub-portions 222-228. This preferred cut pattern enables that all of the sub-portions 222-228 have substantially the same leg or side segment length despite that each of the sets of sub-portions 222-228 has a distinct length. The pod awnings are useful for shading pod windows or doors, and the pod links are useful for linking pod roofs of distinct pods together to create modular tent constructions of multiple pods 2 or for coupling a modular tent construction to another structure, such as a vehicle or a building. The pod fabric may be made from a variety of natural or synthetic materials or blends thereof, however the preferred construction material comprises vinyl sheeting that is strong, waterproof, lightweight and capable of manipulation, such as 18 oz. vinyl sheeting.

Figure 2:
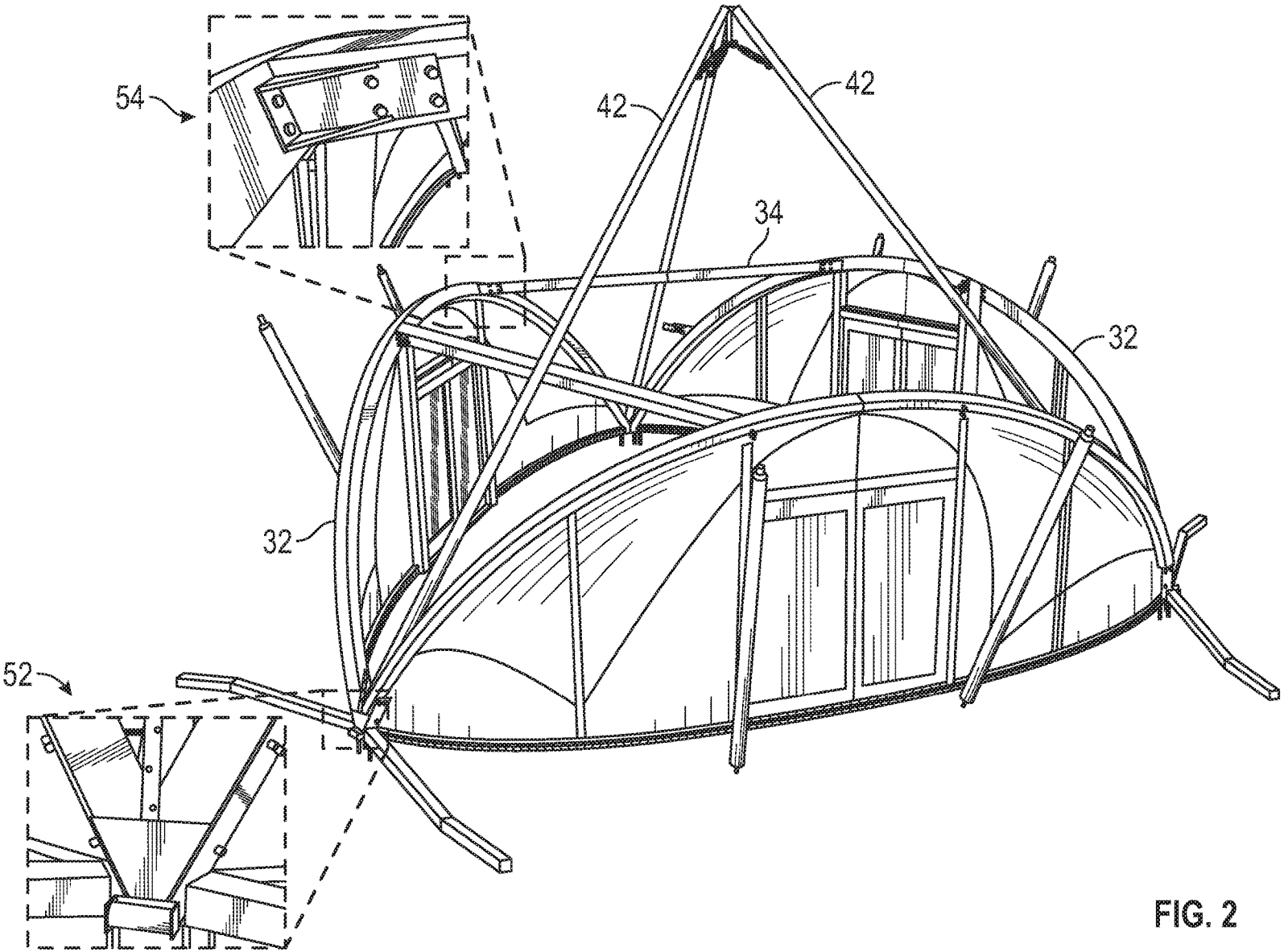
FIG. 2 illustrates a partly assembled view of a pod 2 with detail showing connection of brace beams 34 and the arch beams 32 by a beam bracket 54.
Figure 3:
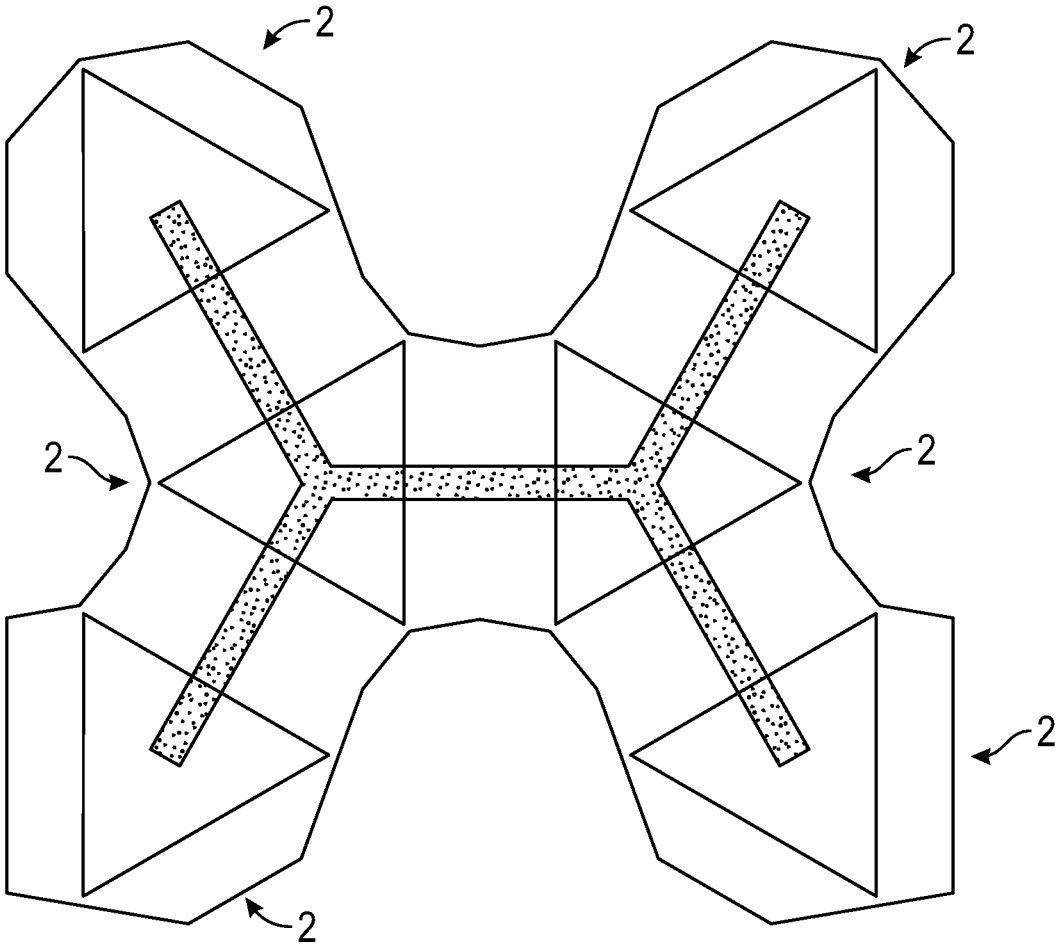
FIGS. 3-4 illustrates a top view showing placement and alignment of each base plate to create a modular tent construction of six tent pods 2.
Figure 4:
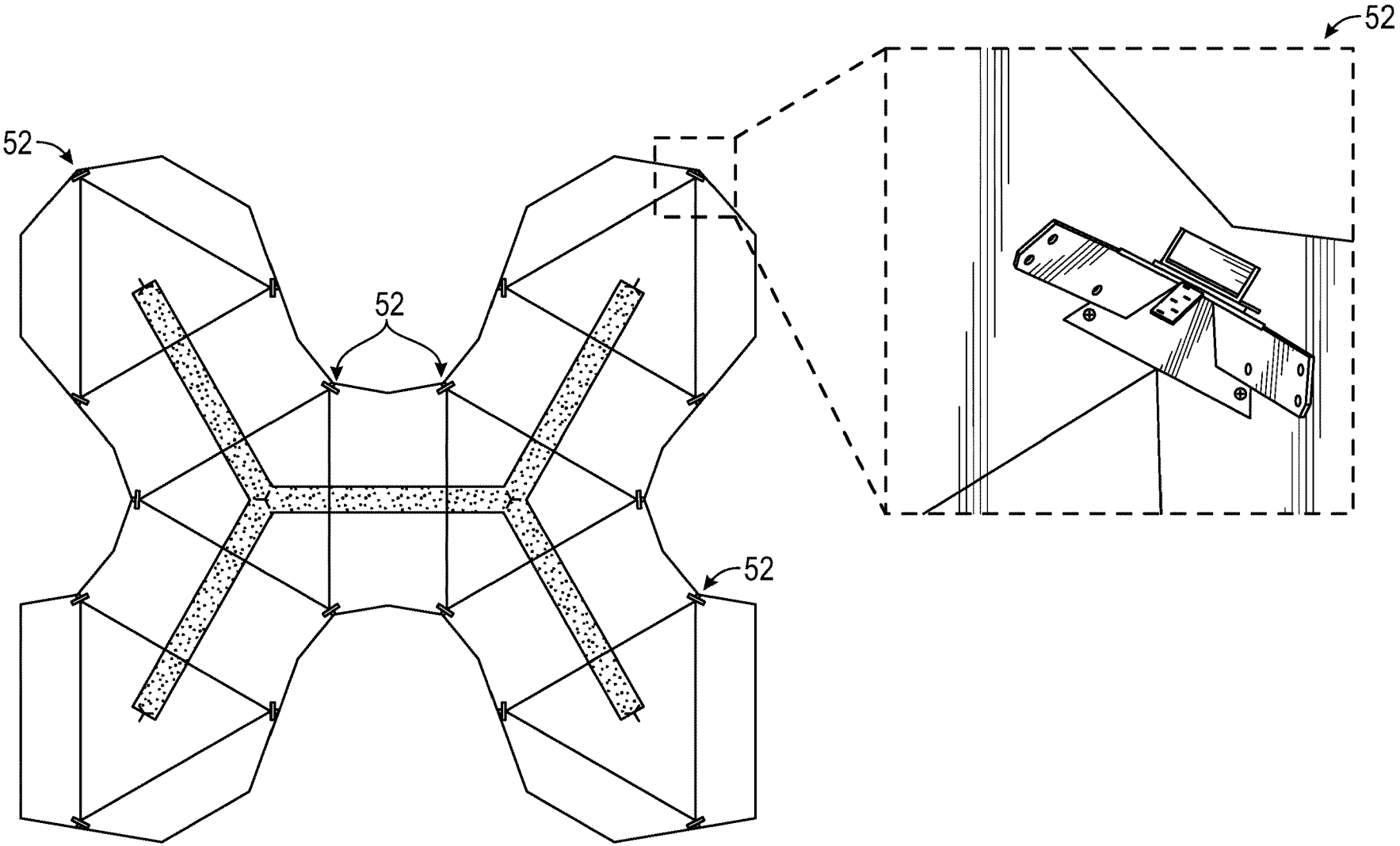
Figure 5A:
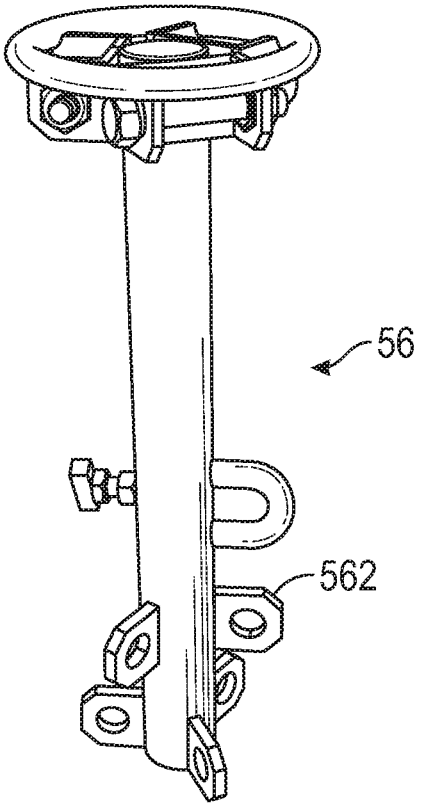
FIGS. 5A-5B illustrate a tripod cage 56 and its connection to the tripod poles 42.
Figure 5B:
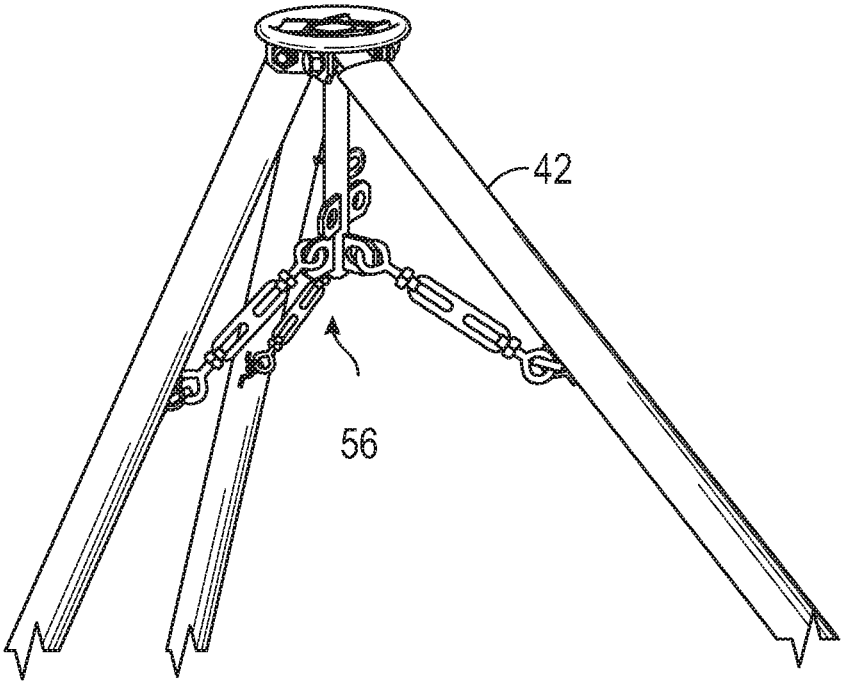

The frame system of preferred embodiments comprises a plurality of arches and a tripod supported by a plurality of braces interconnecting the arches and tripod. Moreover, whereas general purpose hardware may be used to connect the arches, tripod, and braces, specialty hardware designed for use in modular tent constructions is preferred for use with the frame system, which facilitates modular tent construction assembly and adds further integrity to finished modular tent constructions. The pod roof described above is connectable to the arches and tripod whereas the braces resist horizontal stresses or loads on the arches and both horizontal and vertical stresses on the tripod. A preferred embodiment of the frame system is illustrated in FIG. 2 and as may be appreciated, the frame system components may be modified and scalable depending on the size of modular tent construction desired.

The pod roof may be supported by a frame comprised of a set of substantially equally sized poles 42 and a set of substantially equally sized arches 32. Further, each pole 42 may have a pole first end and a pole second end, and each of the pole first ends is indirectly coupled to and supports the pod roof apex. Additionally, the arches 32 have arch midsections and arch-ends and each of the arch midsections are respectively coupled to the pod roof base and each arch-end is positioned adjacently one other arch-end and to one of the pole second ends. A top cone overlaps the main pod roof fabric to create a shingle effect for shedding water and may be by a hook and loop connection but is preferably not permanently attached.

In one preferred embodiment, the arches of the frame system comprise arch beams 32 having a substantially consistent radius and an arc length of slightly less than a half circle. Each of the arch beams 32 is positioned end to end with another of the arch beams 32 and at less than a 180 degree angle to create a perimeter of a pod 2 interior. As illustrated, each of the plurality of arch beams 32 has first and second distal ends that are positioned substantially adjacently end to end with one of the distal ends of a another of the arch beams 32, and to one of the distal ends of a yet another of the arch beams 32, respectively. As an example, in the illustrated embodiment, three arch beams 32 are arranged end to end so that the first and second distal ends of the first of the arch beams 32 are connectable to the first distal end of a second of the arch beams 32 and to the second distal end of a third of the arch beams 32, respectively; and the first and second distal ends of the second of the arch beams 32 are connectable to second distal end of the first of the arch beams 32, and connectable to the first distal end of a third of the arch beams 32, respectively. Further, each of the arch beams 32 may be oriented to lean outward relative to the created pod 2 interior and at an acute angle relative to a vertical axis emerging from the surface upon which the pod 2 is positioned. The acute angle may be in the range of about 10-45 degrees; however the preferred acute angle is a 20 degree angle relative to a vertical axis emerging from the surface upon which the pod 2 is positioned.

The plurality of preferred braces is comprised of a plurality of horizontally oriented brace beams 34, which are connected between the arch beams 32 and support the arch beams 32 against horizontal oriented forces or loads. In a modular tent construction comprised of three arch beams 32, each of the brace beams 34 is connected to and between two of the three arch beams 32 such that a first of the brace beams 34 is connected between the first and second arch beams 32, and a second of the brace beams 34 is connected between the second and third arch beams 32, and a third of the brace beams 34 is connected between the third and first arch beams 32. As illustrated, during assembly of each arch beams 32 two brace beams 34 are connected to the arch beams 32 on either side of the highest part or the apex of the arch in each of the arch beams 32 and the brace beams 34 are connected to the arch beams 32 at acute angles relative to the connected segments of the arch beams 32. Moreover, whereas a range of acute angle between about 45 and 80 degrees may be used, the preferred acute angles relative to the connected segments of the arch beams 32 are 60 degree angles. The tripod 4 is preferably formed by a plurality of tripod poles 42. See FIG. The preferred tripod construction is to form a tripod by placement of a first end of each of the tripod poles 42 at or near between where two arch beams 32 distal ends meet at a bracket designed to receive the beams 32 or alternately, on the surface upon which the arch beams 32 is constructed, and placement of a second end of each of the tripod poles 42 together at a tripod apex. Further, the tripod poles 42 are preferably supported by and make perpendicularly oriented contact against the brace beams 34. As further illustrated, awnings formed of awning extension portions 52 and one or more awning support poles 54 may be added to the modular tent construction.

Figure 6C:
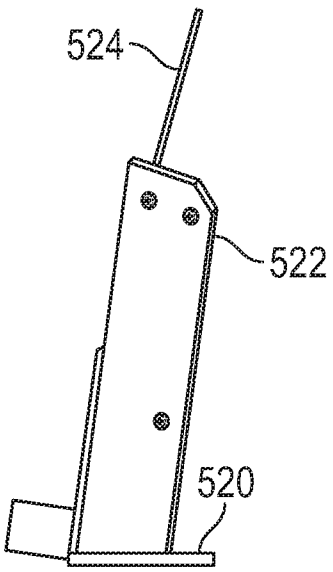
FIGS. 6A-6C illustrate views of a base plate 52.
Figure 6B:
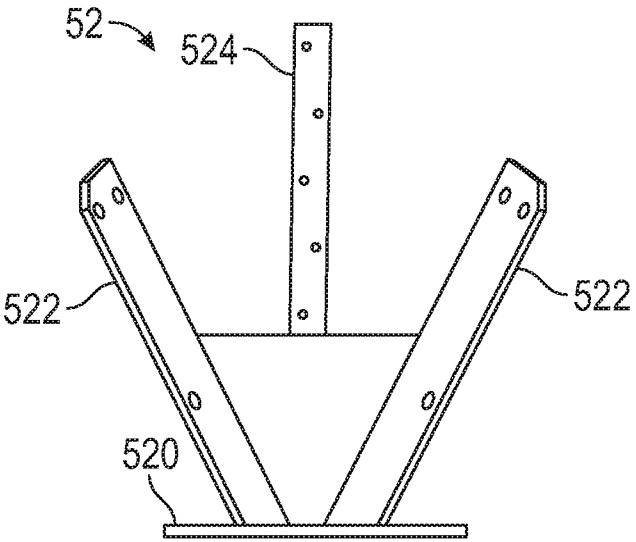
Figure 6A:
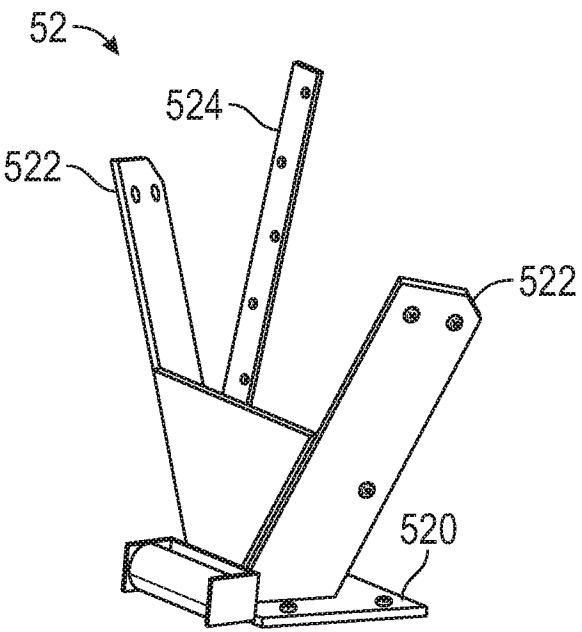
Figure 7B:
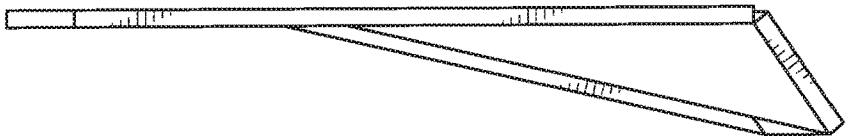
FIGS. 7A-7D illustrate views of a beam bracket 54.
Figure 7D:
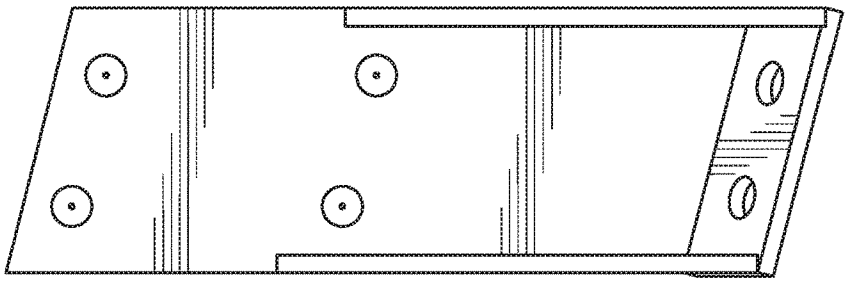
Figure 7A:
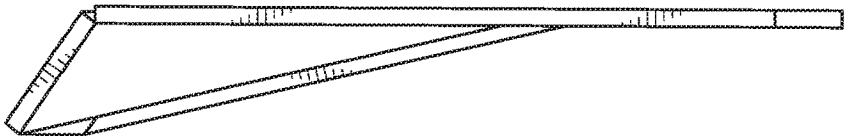
Figure 7C:
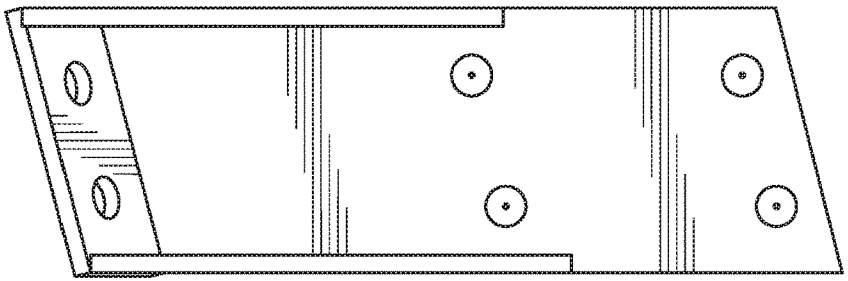
Figure 8:
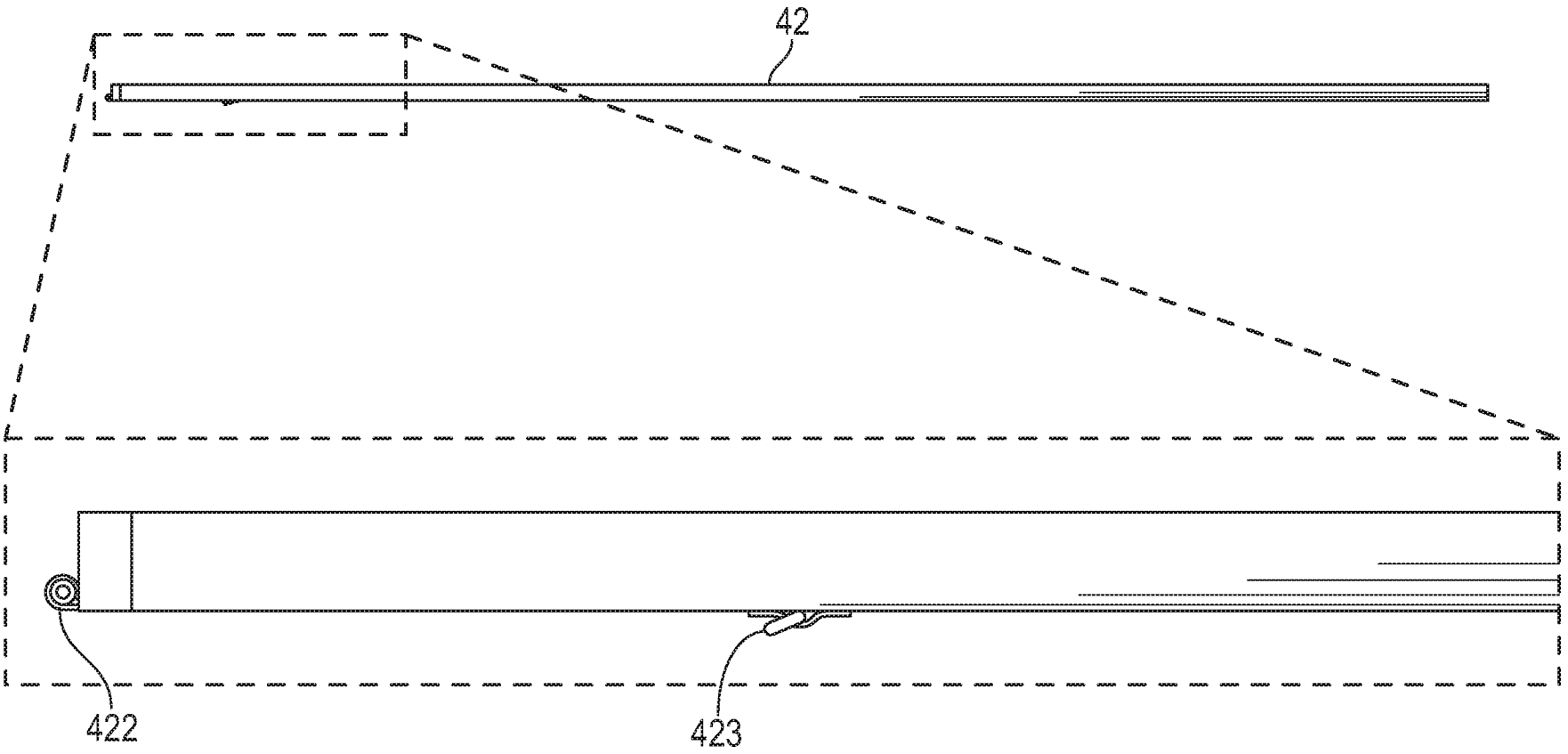
FIG. 8 illustrates a preferred variation of one of the plurality of tripod poles 42, the distal pole 42 end including a hinge-sleeve 422 that is fitted between the tabs at the top of the tripod cage 56 and receives one of the three bolts to secure the pole 42, the pole 42 also including attachment hardware, such as a D-ring 423 to receive and tension a turnbuckle against another tab 562 located on the tripod cage 56 as illustrated in FIGS. 5A-5B.
Figure 9:
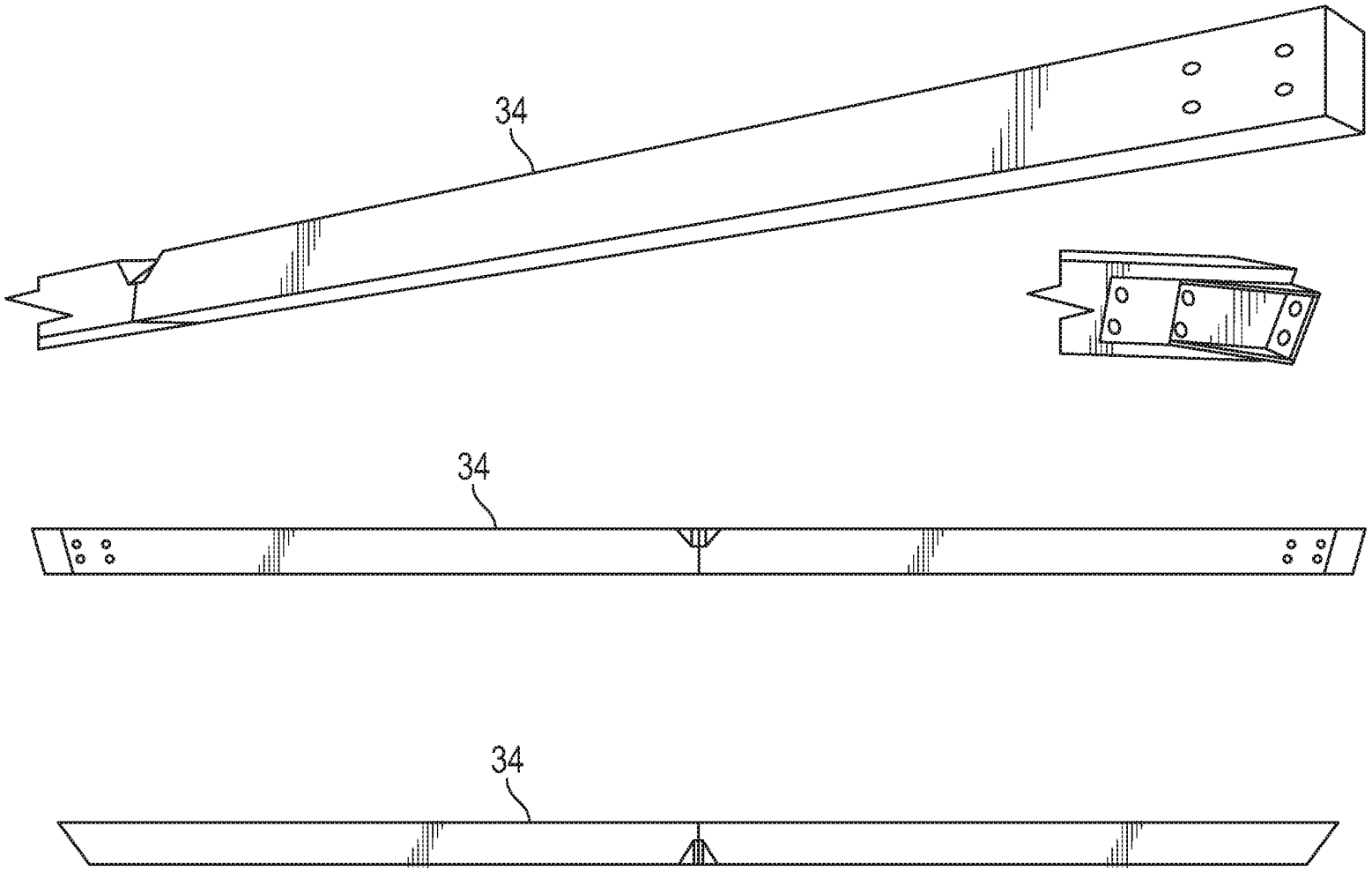
FIG. 9 illustrates a preferred variation of one of the plurality of brace beams 34 and attachment of a beam bracket 54.
Figure 10:
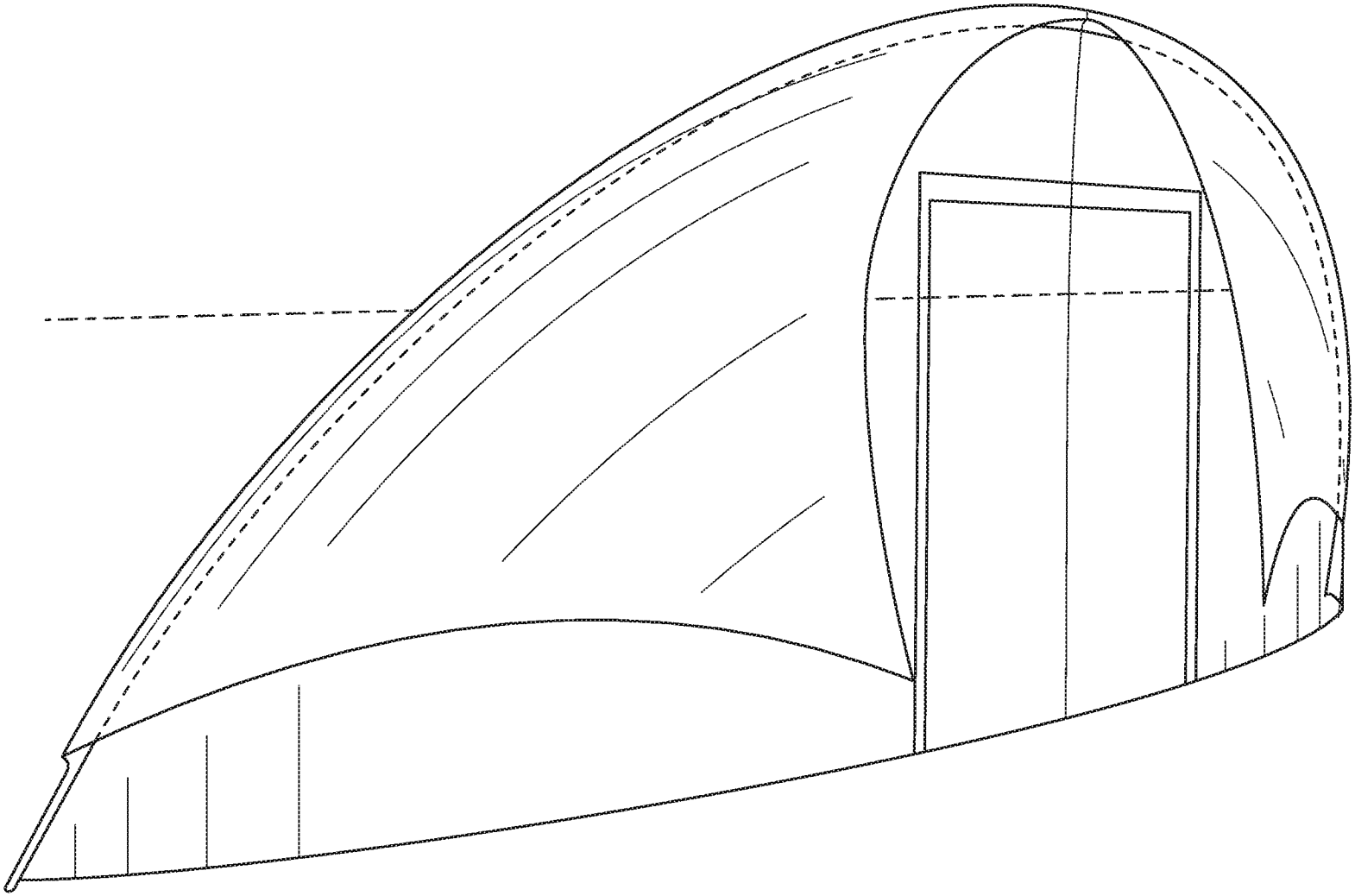
FIG. 10 illustrate preferred assembly, cut patterns, and assembly of a door for a pod 2.

It is preferred that each tent pod include connecting hardware including brackets and/or tensioners that interconnect the fabric skin and frame system to form one or more pods 2. The preferred brackets include at least one base plate 52, at least one beam bracket 54, and a tripod cage 56. The base plate 52 contact the surface upon which the pod 2 is being built and are connectable to each of the distal ends of arch beams 32 arranged adjacently in the constructed pod 2. The base plate 52 may also be secured to a floor, ground, or other surface (e.g. such as with spikes or screws) for additional stability and structural integrity. FIGS. 6A-6C illustrate side perspective, front, and side views of an embodiment of a preferred base plate 52, respectively. The base plate 52 includes a floor plate 520, first and second arch beam plates 522, and a pole bracket 524. The floor plate 520 is substantially flat and orientable horizontally to a ground surface upon which the pod 2 will be built and first and second arch beam plates 522 that extend upward from the floor plate 520, the first at an angle between about plus thirty (+30) degrees and plus forty-five (45) degrees from the vertical axis between the first and second arch beam plates 522, and the second at an angle between about minus thirty (−30) degrees and minus forty-five (−45) degrees from the vertical axis between the first and second arch beam plates 522, as illustrated in FIG. 6B. Moreover, the first and second arch beam plates 522 may each also angle inward towards the interior of the pod 2 at an angle of between about ten (10) degrees and twenty (20) degrees as illustrated in FIG. 6C. A preferred beam bracket 54 comprises an angle bracket of about forty-five (45) degrees as illustrated in FIGS. 7A-7D and facilitates connection of the brace beams 34 to the arch beams 32. As illustrated in the detail of FIG. 2, a beam bracket 54 may be positioned on either or both sides of the brace beams 34 to connect the brace beams 34 to the arch beams 32. The pole bracket 524 also extends upward and inward (relative to the pod 2 interior) at an acute angle relative to a vertical extending from the floor plate 520 and is preferably positioned between the first and second arch beam plates 522. A winch 526 is also attached to the floor plate 520 and is positioned facing outward (relative to the pod 2 interior) to facilitate tensioning of the pod 2 roof fabric between the base plate 52 at one end of the tripod pole 42 and tripod apex at a second end of the tripod pole 42. During assembly of a pod 2, the distal ends of two adjacently positioned arch beams 32 are connectable to the base plate 52 and one of the tripod poles 42 is connectable to the pole bracket 524 with standard fastening hardware such as screws or nuts and bolts. A preferred tripod cage 56 is illustrated in FIG. 6A and is connectable to the top ends of the tripod poles 42 as illustrated in FIG. 6B to hold the tripod poles 42 in place and attachment points for setup equipment such as pulleys and climbing ropes, as well as attachment points for turnbuckles and the fabric skin top cone. A preferred tripod cage 56 comprises a longitudinal member that is oriented vertically at the pod roof apex and has hardware to secure to tripod poles 42 ends and tabs 562 extending from the member to which turnbuckles are connectable and tensioned against a D-ring 423 on the poles 42 at a location near, but not at, the tripod poles 42 ends. Finally, miscellaneous components include turnbuckles, cable(s) and winch tensioners. Turnbuckles lock the position of the tripod cage 56 in relation to the tripod poles 42 preventing swaying, and are used to hold the fabric pod roof shape. Cables are used and when tensioned using a cable winch on each base plate 52, the cable moves down the outer face of the arch beams 32, to tension in the pod 2 fabric relative to the tripod poles 42 and the arch beams 32. Screws and an aluminum strip are normally used to attach the link where it meets the floor or surface. The wall/window is screwed to the arch beams 32 and a wall plate attached to the floor to hold it in place. Hinged Doors can be incorporated into any wall/window panel. A standard door frame is mounted to the floor and to the underside of the arch beams 32. The door opening is cut out of the fabric, and then the door molding attached to sandwich the fabric between the door frame and molding.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

The invention claimed is:

1. A tent pod, comprising:

a plurality of curved substantially triangular shaped roof sections connected together to form a curved pyramidal pod roof having a roof base and a roof apex, the curved substantially triangular shaped roof sections each comprised of curved substantially trapezoidal sub-portions with top and bottom base segments, each of the top base segments of all but one of the sub-portions coupled to the bottom base segment of another sub-portion, respectively; and a frame system comprised of a plurality of arches and a plurality of poles, at least two of the arches having an arch end positioned adjacent another arch end and having an arch middle section coupled to the roof base, the poles coupled at first ends to the roof apex.

2. The tent pod in claim 1 wherein, the curved substantially triangular shaped roof sections are each comprised of three curved substantially trapezoidal sub-portions.

3. The tent pod in claim 2 wherein, the curved substantially trapezoidal sub-portions have sub-portion base segments and the sub-portion base segment of a first sub-portion is about 1.5 to 2.5 times longer than the sub-portion base segment of a second sub-portion.

4. The tent pod in claim 1, wherein the curved substantially triangular shaped roof sections are each comprised of four curved substantially trapezoidal sub-portions.

5. The tent pod in claim 4 wherein, the curved substantially trapezoidal sub-portions have sub-portion base segments and sub-portion base segment of first sub-portion is about 1.5 to 2.5 times longer than the sub-portion base segment of a second sub-portion.

6. The tent in claim 1 further comprising, a plurality of base plates, each arch end positioned adjacent another arch end on one of the base plates, and the poles each have second ends, each of which are coupled to one of the base plates.

7. The tent pod in claim 6 wherein, the base plate has a substantially flat floor plate and first and second arch beam plates that extend from the floor plate, the arch ends supported by the floor plate and coupled to the first and second arch beam plates, respectively.

8. The tent pod in claim 7 wherein, the base plate further includes a pole bracket that extends upward from the floor plate, each second end of the poles coupled to one of the pole brackets, respectively.

9. The tent pod in claim 7 wherein, a winch is also attached to the floor plate and tensions the pod roof in a direction towards the base plate.

10. The tent pod in claim 1 wherein, the poles are coupled at the first ends to a tripod cage, the tripod cage comprised of a pipe with a plurality of strap rollers and tabs extending perpendicularly therefrom.

11. A tend pod, comprising:

a pod roof including an assembly of fabric pod roof portions with substantially equivalent dimensions each fabric pod roof portion comprised of a composite of curved substantially trapezoidal sub-portions with top and bottom base segments, each of the top base segments of all but one of the sub-portions coupled to the bottom base segment of another sub-portion, respectively, the leg segments of each pod roof portion angle towards each other and each are coupled to one of the leg segments of another pod roof portion forming a pod roof vertex;

a frame comprised of a set of poles and a set of arches, poles with a pole first end and a pole second end, the pole first ends coupled to the pod roof vertex, the arches having arch midsections and arch-ends, the arch midsections respectively coupled to the base segments, each arch-end positioned adjacently one other arch-end and to one of the pole second ends.

12. The tent pod in claim 11, wherein each fabric pod roof portion comprises a composite of three curved substantially trapezoidal sub-portions.

13. The tent pod in claim 12, wherein each of the bottom base segments of all but one of the sub-portions is coupled along and to the top base segment of another of the sub-portions, respectively.

14. The tent pod in claim 12, wherein the bottom base segment of one of the sub-portions is coupled to one of the arch midsections.

15. The tent pod in claim 11, wherein each fabric pod roof portion comprises a composite of four curved substantially trapezoidal sub-portions.

16. The tent pod in claim 15, wherein each of the bottom base segments of all but one of the sub-portions is coupled along and to top base segment of another of the sub-portions, respectively.

17. The tent pod in claim 15, wherein the bottom base segment of one of the sub-portions is coupled to one of the arch midsections.

18. The tent pod in claim 11, wherein each arch-end and pole second end is coupled to and secured by a substantially flat plate.

19. The tent pod in claim 11, wherein the frame includes a longitudinal member extending downward from the pod roof vertex and each pole first end is securable to the member at first and second locations.

20. The tent pod in claim 11, wherein the frame is coupled to the pod roof vertex by a longitudinal bracket, each pole first end is securable to the longitudinal bracket at first and second locations.

* * * * *